US006971295B2

(12) United States Patent
Teshima

(10) Patent No.: US 6,971,295 B2
(45) Date of Patent: Dec. 6, 2005

(54) SHEET DELIVERY APPARATUS

(75) Inventor: Tsunetoshi Teshima, Yamato (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 345 days.

(21) Appl. No.: 10/453,664

(22) Filed: Jun. 4, 2003

(65) Prior Publication Data

US 2004/0074357 A1 Apr. 22, 2004

(30) Foreign Application Priority Data

Oct. 18, 2002 (JP) ..... P2002-303741

(51) Int. Cl.[7] ..... B26D 1/62

(52) U.S. Cl. ..... 83/162; 83/169; 83/346; 271/188

(58) Field of Search ..... 83/169, 22, 346, 83/162; 162/197, 271; 271/188; 493/459

(56) References Cited

U.S. PATENT DOCUMENTS 2,261,315 A * 11/1941 Thorsen ..... 83/303
2,471,447 A * 5/1949 Perkins ..... 425/303
4,060,236 A * 11/1977 Carstedt ..... 271/183
4,539,072 A * 9/1985 Frye et al. ..... 162/197
5,141,484 A * 8/1992 Akira ..... 493/8
5,188,271 A * 2/1993 Dannatt ..... 226/102
5,363,728 A * 11/1994 Elsner et al. ..... 83/23
5,696,105 A * 12/1997 Hackler ..... 514/172
5,771,603 A * 6/1998 Kotitschke et al. ..... 34/446
5,839,365 A 11/1998 Calbrix et al.
6,669,620 B2 * 12/2003 Weder et al. ..... 493/459
6,767,431 B2 * 7/2004 Komulainen et al. ..... 162/198

FOREIGN PATENT DOCUMENTS

JP 1-22120 4/1989
JP 10-87162 4/1998

* cited by examiner

*Primary Examiner*—Kenneth E. Peterson
(74) *Attorney, Agent, or Firm*—Westerman, Hattori, Daniels & Adrian, LLP

(57) ABSTRACT

A sheet delivery apparatus includes a cutter cylinder, a cutter reception cylinder, and a conveyor provided downstream of the cylinders. The cutter cylinder and the cutter reception cylinder cooperatively cut a paper web so as to yield sheets of predetermined size. The sheets are delivered by the conveyor. A dampening unit is provided upstream of a region where the cutter cylinder and the cutter reception cylinder closely face each other and in the vicinity of the paper web so as to dampen the paper web such that the surface of the paper web which will face the cutter cylinder is dampened to a greater extent than is the other surface.

4 Claims, 4 Drawing Sheets

SHEET DELIVERY APPARATUS

BACKGROUND OF THE INVENTION

1. Field of the Invention

The present invention relates to a sheet delivery apparatus adapted such that a paper web which has undergone printing in a printing apparatus of a rotary printing press is fed into a region between a cutter cylinder and a cutter reception cylinder; the fed paper web is cut across the width thereof into a sheet of predetermined size; and the sheet is delivered by means of a conveyor.

2. Description of the Related Art

Conventional sheet delivery apparatus are disclosed in, for example, U.S. Pat. No. 5,839,365, Japanese Patent Publication (kokoku) No. H01-22120, and Japanese Patent Application Laid-Open (kokai) No. H10-87162. In the disclosed delivery apparatus, a traveling paper web is fed into a region between a cutter cylinder and a cutter reception cylinder, and the thus-cut sheet and a cut end portion of the paper web are stably guided toward a downstream conveyor.

The sheet delivery apparatus disclosed in U.S. Pat. No. 5,839,365 (prior art 1) includes a cutter cylinder, a cutter reception cylinder, guide means, and a conveyor. The cutter cylinder and the cutter reception cylinder cooperatively cut a paper web which is fed into a region therebetween from the upstream. The guide means disposed on opposite sides of a paper web path guide the thus-cut sheet and a cut end portion of the web paper toward the downstream conveyor. The conveyor transports further downstream a sheet which has been cut from the paper web while being guided by the guide means.

The cutter cylinder has cutter blades provided at predetermined intervals on the outer circumferential surface thereof. The cutter reception cylinder has cutter receivers provided, for receiving the corresponding cutter blades, at predetermined intervals on the outer circumferential surface thereof.

The guide means are provided on opposite sides of the paper web path and extends from a region which is located in the vicinity of the outer circumferential surfaces of the cutter and cutter reception cylinders and downstream of a cutting position located between the cutter cylinder and the cutter reception cylinder, to a region located in the vicinity of a pair of rollers which face each other with an appropriate gap present therebetween; rotate in opposite directions; and serve as an entrance to the conveyor.

The conveyor includes two independent sections provided on opposite sides of a sheet path. Each of the sections is configured such that an endless belt is looped around and mounted on the entrance roller and downstream rollers. In order to hold a fed sheet therebetween, the facing endless belts come into contact with each other at an appropriate position located downstream of the entrance rollers.

According to the above-described configuration, the paper web is fed to a region between the cutter cylinder and the cutter reception cylinder so as to undergo cutting. A sheet obtained through such cutting and present downstream of the cutting position is transported downstream while being held between the endless belts of the conveyor.

Even when a portion of the paper web located upstream of the cutting position is subjected to air resistance associated with traveling thereof, the guide means guide a cut end portion of the paper web toward the conveyor so as to prevent the same from being turned up or dog-eared. When the cut end portion of the paper web reaches the position where the facing endless belts of the conveyor come into contact with each other, a portion of the paper web passing through the region between the cutter cylinder and the cutter reception cylinder is cut through cooperation between the cutter and the corresponding cutter receiver, thereby yielding a sheet. The sheet is transported downstream while being held between the endless belts of the conveyor to thereby be delivered from the sheet delivery apparatus.

The sheet delivery apparatus disclosed in Japanese Patent Publication (kokoku) No. H01-22120 (prior art 2) includes a cutter cylinder, a cutter reception cylinder, a pair of brush rollers, and a conveyor. The cutter cylinder and the cutter reception cylinder cooperatively cut a paper web which is fed into a region therebetween from the upstream. The paired brush rollers are provided in contact with the. outer circumferential surfaces of the cutter cylinder and the cutter reception cylinder, respectively, at a position located downstream of the cutting position in such a manner as to be rotatable in directions counter to those of the cutter and cutter reception cylinders, respectively, and are adapted to guide the cut sheet or a cut end portion of the paper web toward the downstream. The conveyor is disposed downstream of the paired brush rollers and is adapted to transport the cut sheet further downstream.

The cutter cylinder has cutter blades provided at predetermined intervals on the outer circumferential surface thereof. The cutter reception cylinder has cutter receivers provided, for receiving the corresponding cutter blades, at predetermined intervals on the outer circumferential surface thereof.

The paired brush rollers are provided in contact with the outer circumferential surfaces of the cutter cylinder and the cutter reception cylinder, respectively, at a position located downstream of the cutting position, where the cutter cylinder and the cutter reception cylinder cooperatively cut the paper web, in such a rotatable condition that the outer circumferential surface of each of the paired brushes and the outer circumferential surface of the cutter or cutter reception cylinder move in opposite directions at their contact position. Each of the paired brush rollers includes a roller on which brushes and pulleys are arranged at appropriate intervals in the axial direction.

The conveyor includes two independent sections provided on opposite sides of a sheet path. Each of the sections is configured such that endless belts are looped around and mounted on respective pulleys of the brush roller and respective downstream rollers. In order to hold a fed sheet therebetween, the facing endless belts come into contact with each other at an appropriate position located downstream of the brush rollers.

According to the above-described configuration, the paper web is fed to a region between the cutter cylinder and the cutter reception cylinder so as to undergo cutting. A sheet obtained through such cutting and present downstream of the cutting position is transported downstream while being held between the endless belts of the conveyor.

Even when static electricity is generated on a portion of the paper web located upstream of the cutting position and causes a cut end portion of the paper web to attract to and move together with the outer circumferential surface of the cutter cylinder or the cutter reception cylinder, the brushes of the brush roller associated with the cutter cylinder or the cutter reception cylinder to which the cut end portion is attracted peel off the cut end portion from the outer circumferential surface of the cylinder, whereby the cut end portion is guided toward the conveyor.

When the thus-guided cut end portion of the paper web reaches the position where the facing endless belts of the conveyor come into contact with each other, a portion of the paper web passing through the region between the cutter cylinder and the cutter reception cylinder is cut through cooperation between the cutter and the corresponding cutter receiver, thereby yielding a sheet. The sheet is transported downstream while being held between the endless belts of the conveyor to thereby be delivered from the sheet delivery apparatus.

The sheet delivery apparatus disclosed in Japanese Patent Application Laid-Open (kokai) No. H10-87162 (prior art 3) includes a cutter cylinder, a cutter reception cylinder, and a pair of transport means. The cutter cylinder and the cutter reception cylinder cooperatively cut a paper web which is fed into a region therebetween from the upstream. The paired transport means are disposed around the cutter cylinder and the cutter reception cylinder, respectively, and are in contact with each other along a paper web path including the cutting position so as to guide the paper web along the paper web path.

The cutter cylinder has cutter blades provided at predetermined intervals on the outer circumferential surface thereof. The cutter reception cylinder has cutter receivers provided, for receiving the corresponding cutter blades, at predetermined intervals on the outer circumferential surface thereof.

The transport means are disposed in such a manner as not to interfere with the cutters of the cutter cylinder and the cutter receivers of the cutter reception cylinder and assume the form of a pair of endless belts of opposite rotational directions. The paired endless belts face each other along the paper web path including the cutting position so as to hold the paper web therebetween along the paper web path.

According to the above-described configuration, the paper web is guided toward the downstream while being held between the transport means, and undergoes cutting in a region between the cutter cylinder and the cutter reception cylinder. A sheet obtained through such cutting and present downstream of the cutting position is transported downstream while being held between the transport means.

A portion of the paper web located upstream of the cutting position is transported downstream while being held between the transport means. A portion of the paper web passing through the region between the cutter cylinder and the cutter reception cylinder is cut at an appropriate position through cooperation between the cutter and the corresponding cutter receiver, thereby yielding a sheet. The sheet is transported downstream while being held between the transport means to thereby be delivered from the sheet delivery apparatus.

Prior art 1 involves the following problem. When the paper web is electrostatically charged, a cut end portion of the paper web is attracted to the outer circumferential surface of the cutter cylinder or the cutter reception cylinder. As a result, the cut end portion of the paper web enters the gap between the guide means and either the cutter cylinder or the cutter reception cylinder and winds around the cylinder, resulting in occurrence of a paper jam. Such a paper jam leads to stoppage of machine operation or breakage of the guide means.

Prior art 2 involves the following problem. When static electricity causes a cut end portion of the paper web to be attracted to the outer circumferential surface of the cutter cylinder or the cutter reception cylinder, the brushes of the brush roller peel off the cut end portion from the outer circumferential surface to thereby lead the cut end portion to the entrance of the conveyor. However, even in this case, since the cut end portion of the paper web has already been drawn from the cutting position along the outer circumferential surface of the cylinder, rotation of the brush roller causes the cut end portion to be temporarily moved backward toward the upstream. This backward movement of the cut end portion of the paper web resists feed of the paper web from the upstream, potentially resulting in feed of the paper web in a crumpled condition to the conveyor. The thus-yielded sheet becomes a defective product and results in waste of paper.

Prior art 3 involves the following problem. Since the transport means are provided around the cutter cylinder and the cutter reception cylinder, respectively, in such a manner as not to interfere with the cutters and cutter receivers, the overall scale of apparatus increases considerably. Thus, the number of components increases with a resultant increase in cost. Also, since endless-belt-like members wider than the paper width surround the cutter cylinder and the cutter reception cylinder, respectively, maintenance of the cylinders is difficult to perform.

SUMMARY OF THE INVENTION

An object of the present invention is to solve the above-mentioned problems in the conventional sheet delivery apparatus and to provide a sheet delivery apparatus in which a cut end portion of a paper web resulting from the paper web being cut through cooperation of a cutter cylinder and a cutter reception cylinder is not attracted to and does not wind around the outer circumferential surface of either one of the cylinders, and is thus smoothly led to the subsequent transport device, to thereby avoid occurrence of a paper jam which could cause stoppage of machine operation or breakage of peripheral components; which allows smooth transport of the paper web for prevention of occurrence of folds or wrinkles on the cut end portion of the paper web, to thereby reduce waste of paper; and which employs simple mechanisms to thereby reduce cost and facilitate maintenance.

To achieve the above object, a sheet delivery apparatus of the present invention is adapted to cut a paper web transported from a printing apparatus across the width of the web for obtaining a sheet of predetermined size, and to transport the sheet toward the downstream. The sheet delivery apparatus includes a cutter cylinder and a cutter reception cylinder, which are provided in parallel with and in the vicinity of each other; nipping rollers for feeding the paper web to the paired cutter and cutter reception cylinders; at least one guide bar; at least one dampening unit; and a conveyor provided downstream of the guide bar.

Herein, the terms "upstream" and "downstream" are used in relation to the traveling direction of a paper web.

Cutter blades are provided on the outer circumferential surface of the cutter cylinder at equal circumferential intervals, and cutter receivers are provided on the outer circumferential surface of the cutter reception cylinder at equal circumferential intervals. The cutter cylinder and the cutter reception cylinder are rotated synchronously in such a manner that the cutter blades and the corresponding cutter receivers meet and cut the paper web to obtain sheets of a predetermined length.

The guide bar is disposed in a groove formed circumferentially on an outer circumferential surface of the cutter reception cylinder. The guide bar extends substantially in parallel with the traveling direction of the paper web. In the groove, the guide bar passes through an imaginary plane including an axis of the cutter cylinder and an axis of the cutter reception cylinder.

Preferably, the guide bar is a plate-like member which is disposed such that, in the closely-facing region where the cutter cylinder and the cutter reception cylinder closely face each other, the member is disposed in the groove of the cutter reception cylinder in such a manner as not to come into contact with the cutter reception cylinder, and such that the member is disposed substantially in parallel with the traveling direction of the paper web and in the vicinity of the surface of the traveling paper web. The guide bar is located such that an upstream end thereof is located upstream of a position at which the cutter blade of the cutter cylinder meshes with the corresponding cutter receiver of the cutter reception cylinder and such that a downstream end thereof is located in the vicinity of an entrance to the conveyor.

The dampening unit is provided upstream of the closely facing region of the cutter cylinder and the cutter reception cylinder, in the vicinity of a path of a paper web to be introduced into the sheet delivery apparatus and in the following manner. The dampening unit is provided for each of opposite surfaces of the paper web. Alternatively, the dampening units is provided for the surface of the paper web which surface faces the cutter cylinder. The dampening unit supplies liquid to the paper web in a quantity such that the surface of the paper web which will face the cutter cylinder is dampened to a greater extent than is the other surface.

The conveyor includes a pair of rollers and endless belts corresponding to the rollers. The paired rollers are provided downstream of the closely facing region of the cutter cylinder and the cutter reception cylinder and in the vicinity of the downstream end of the guide bar. The paired rollers face each other with an appropriate gap present therebetween and rotate in mutually opposite directions. The endless belts are looped around and mounted on the corresponding rollers and travel in such a manner as to be superposed on each other in a downstream region.

In the sheet delivery apparatus of the present invention, the dampening unit dampens the paper web so as to raise a difference in degree of dampness between opposite surfaces of the paper web to be cut. Such a difference in degree of dampness causes a cut end portion of the paper web to curve toward the cutter reception cylinder and the guide bar. Further, the guide bar is inserted, substantially in parallel with the traveling direction of the paper web, into the groove formed circumferentially on the outer circumferential surface of the cutter reception cylinder, which faces the cutter cylinder. Therefore, the cut end portion of the paper web moves while being guided by the guide bars. Thus, the cut end portion of the paper web is not attracted to and does not wind around the outer circumferential surface of the cutter cylinder or the cutter reception cylinder.

As a result, there is prevented stoppage of machine operation or breakage of peripheral components which could otherwise result from breakage of the paper web stemming from the cut end portion of the paper web winding around the outer circumferential surface of the cylinder. Also, since occurrence of wrinkles on a sheet and folds of an end portion of the sheet is prevented, waste of paper can be reduced.

Furthermore, since means for preventing the paper web from winding around the outer circumferential surface of the cylinder can be of a simple mechanism, cost of equipment can be reduced, and maintenance can be facilitated.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A sheet delivery apparatus according to an embodiment of the present invention will next be described in detail with reference to the drawings.

In a rotary printing press, paper webs W' are drawn out from respective paper rolls loaded in an unillustrated paper-feeding apparatus, undergo printing in an unillustrated printing apparatus, and are then introduced into a sheet delivery apparatus SD.

Figure 1:
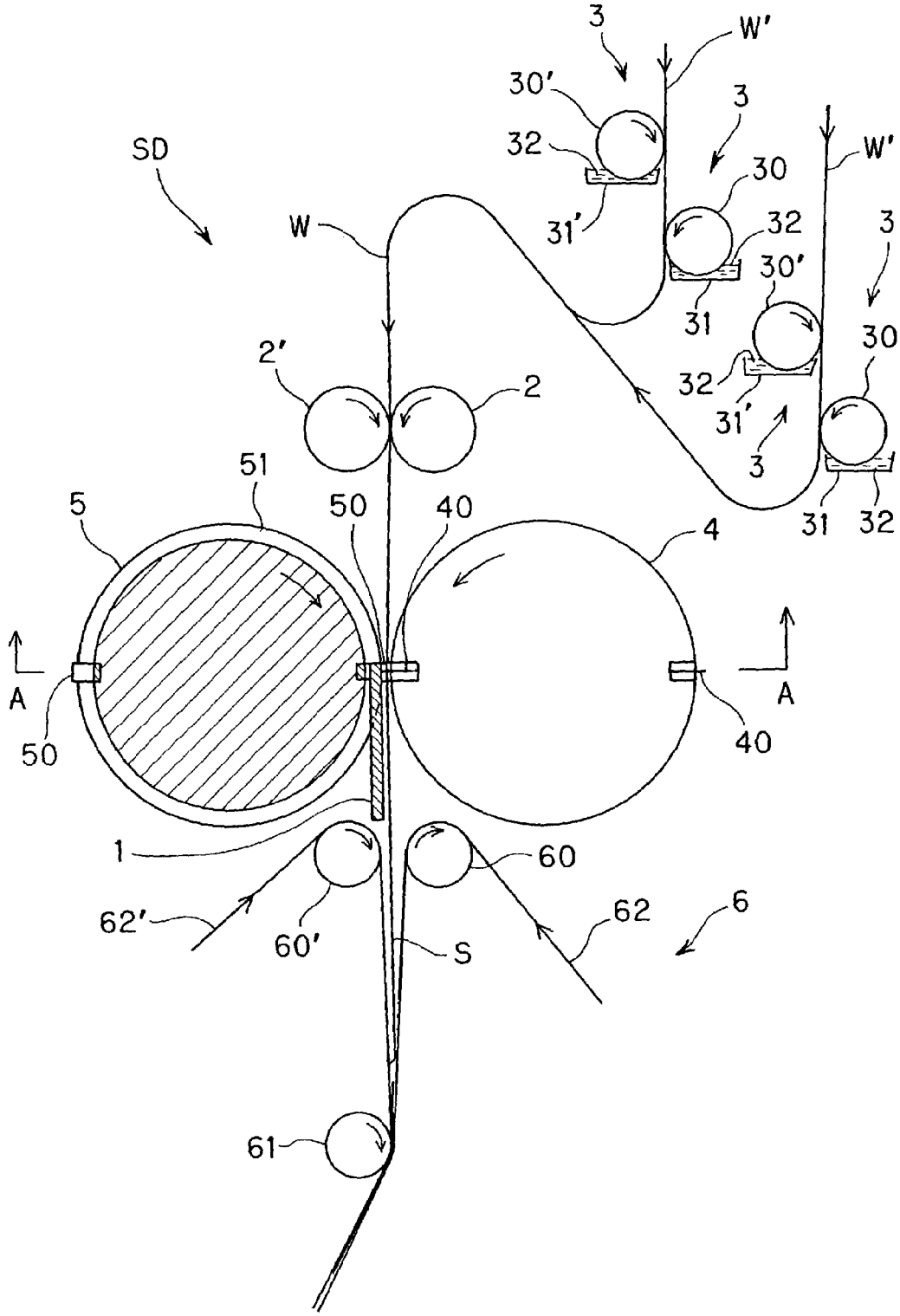
FIG. 1 is a schematic side view of a sheet delivery apparatus according to an embodiment of the present invention.

As shown in FIG. 1, the sheet delivery apparatus SD includes nipping rollers 2 and 2'; a cutter cylinder 4; a cutter reception cylinder 5; guide bars 1; dampening units 3; and a conveyor 6. The sheet delivery apparatus SD cuts a paper web W introduced therein, across the width of the paper web W, thereby yielding sheets S of predetermined size, which are printed material such as leaflets.

In some cases, the sheets S may be introduced into an unillustrated folding apparatus so as to yield printed material in a folded form.

Next, components of the sheet delivery apparatus SD will be described.

(1) Nipping Rollers 2 and 2'

As shown in FIG. 1, the nipping rollers 2 and 2' are at least a pair of drive rollers which are provided in the vicinity of or in contact with each other in such a manner as to rotate in mutually opposite directions. The nipping rollers 2 and 2' rotate in mutually opposite directions so as to transport the paper web W—which consists of a single or a plurality of paper webs arranged in layers and introduced into the sheet delivery apparatus SD from the upstream printing apparatus—toward a region between the cutter cylinder 4 and the cutter reception cylinder 5, which are located downstream thereof and will be described below.

(2) Cutter Cylinder 4 and Cutter Reception Cylinder 5

Figure 2:
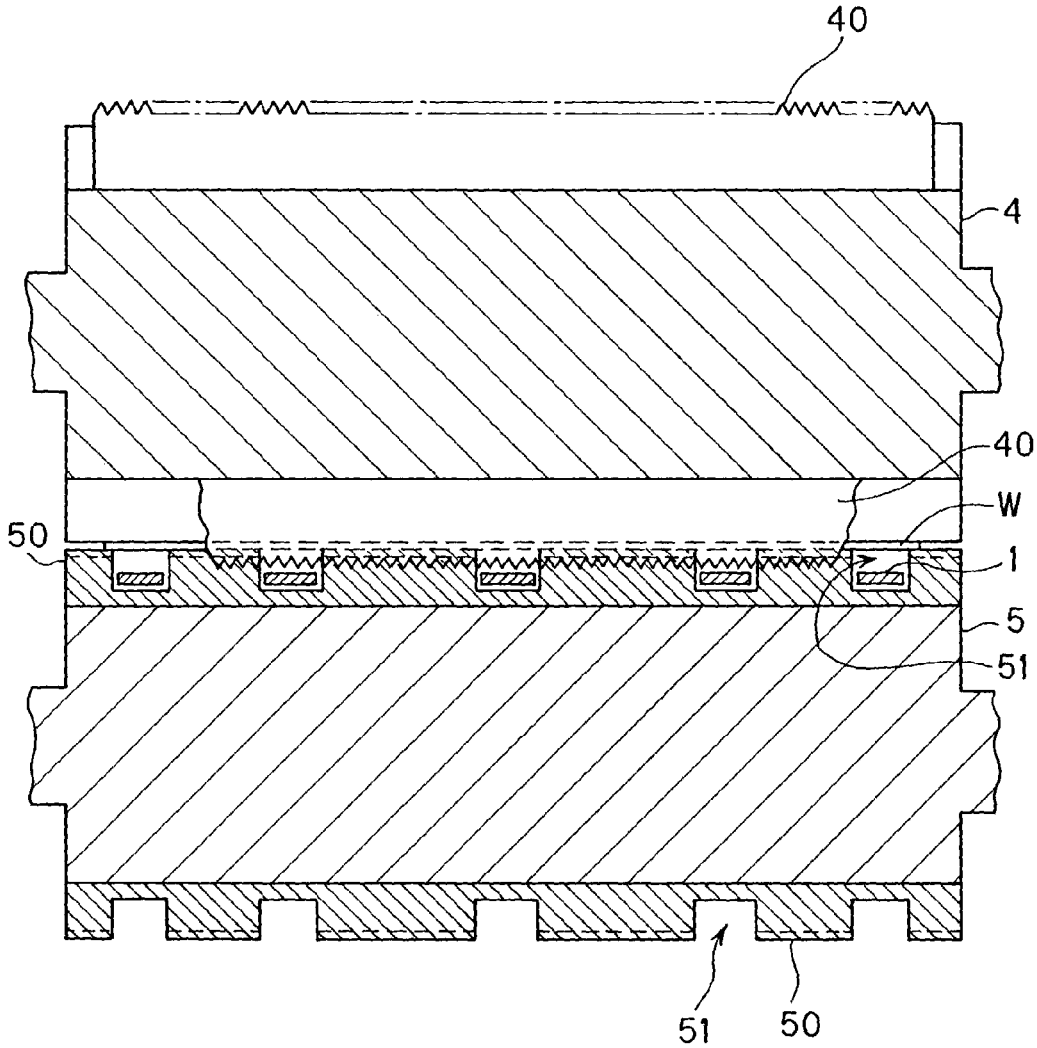
FIG. 2 is a sectional view taken along line A-A of FIG. 1.

As shown in FIGS. 1 and 2, the cutter cylinder 4 and the cutter reception cylinder 5 are provided in parallel with each other in such a manner that their circumferential surfaces closely face each other, and are rotated in mutually opposite directions.

In order to cut the paper web W to predetermined length in cooperation with the cutter reception cylinder 5, the cutter cylinder 4 has cutter blades 40 provided thereon in parallel with the axis thereof. The cutter blades 40 extend across and beyond the paper width.

In order to cut the paper web W introduced into a region between the cutter cylinder 4 and the cutter reception cylinder 5, the cutter reception cylinder 5 has cutter receivers 50 provided thereon for receiving the corresponding cutter blades 40. A plurality of grooves 51 are circumferentially formed on the outer circumferential surface of the cutter reception cylinder 5 in such a manner as to be arranged at appropriate axial intervals.

The cutter blades 40 provided on the cutter cylinder 4 and the cutter receivers 50 provided on the cutter reception cylinder 5 are arranged at equal circumferential intervals (in FIG. 1, at circumferential intervals of half the circumference). The cutter blades 40 and the corresponding cutter receivers 50 meet through synchronous rotation of the cutter cylinder 4 and the cutter reception cylinder 5.

(3) Guide Bars 1

As shown in FIGS. 1 and 2, the guide bars are plate-like members which are disposed such that in a closely facing region where the cutter cylinder and the cutter reception cylinder closely face each other, the members are inserted in the corresponding grooves 51 of the cutter reception cylinder 5 in such a manner as not to come into contact with the cutter reception cylinder; and such that the members are disposed substantially in parallel with the traveling direction of the paper web and in the vicinity of the surface of the traveling paper web.

The guide bars 1 are provided such that the upstream ends thereof are located upstream of an imaginary plane including the axis of the cutter cylinder 4 and the axis of the cutter reception cylinder 5; i.e., upstream of a position at which the cutter blade 40 of the cutter cylinder 4 meshes with the corresponding cutter receiver 50 of the cutter reception cylinder 5, and such that the downstream ends thereof are located in the vicinity of an entrance to the conveyor 6.

As shown in FIG. 2, the guide bars 1 are present in the corresponding grooves 51 such that, when the cutter blade 40 of the cutter cylinder 4 and the cutter receiver 50 of the cutter reception cylinder 5 mesh with each other, the tip of the cutter blade 40 does not come into contact with the guide bars 1.

(4) Dampening Units 3

As shown in FIG. 1, the dampening units 3 are provided upstream of the closely facing region of the cutter cylinder 4 and the cutter reception cylinder 5, in the vicinity of corresponding paths of the paper webs W' to be introduced into the sheet delivery apparatus SD, and are each provided for each of opposite surfaces of the corresponding paper web W'. Each of the dampening units 3 includes a liquid pan 31 or 31' for containing liquid 32, such as water, for dampening the surface of the paper web W', and a roller 30 or 30' immersed in the liquid 32 and rotated while being in contact with the surface of the paper web W'. A set consisting of the roller 30 and the liquid pan 31 associated with the cutter cylinder 4 and a set consisting of the roller 30' and the liquid pan 31' associated with the cutter reception cylinder 5 are positionally shifted from each other along the traveling direction of the paper web W'.

Rotational speed of the rollers 30 and 30' can be adjusted in order to adjust the quantity of the liquid 32 to be transferred onto the surface of the paper web W'—which is traveling in contact with the outer circumferential surfaces of the rollers 30 and 30'—via the outer circumferential surfaces of the rollers 30 and 30'.

In the present embodiment, in order to transfer a greater quantity of the liquid 32 onto the surface of the paper web W' which will face the cutter cylinder 4 as compared with the quantity of the liquid 32 to be transferred onto the other surface, the rotational speed of the roller 30 is adjusted to be higher than that of the roller 30', in dampening the paper web W'.

Alternatively, each of the dampening units 3 may be provided only for the surface of the paper web W' which will face the cutter cylinder 4, in order to only dampen the surface. In this case, the degree of dampness of the paper web W' is adjusted through adjustment of the rotational speed of the roller 30.

In place of the rollers 30 and 30', a plurality of nozzles may be used in the following manner. The nozzles are provided in such a manner as to face opposite surfaces of each of the paper webs W' or to face the surface of each of the paper webs W' which will face the cutter cylinder 4. The liquid 32 is sprayed over the surfaces of the paper webs W' for dampening.

(5) Conveyor 6

As shown in FIG. 1, the conveyor 6 includes a pair of trains of rollers, and a pair of endless belts 62 and 62' looped around and mounted on the corresponding roller trains. The roller trains include a pair of rollers 60 and 60' provided downstream of the closely facing region of the cutter cylinder 4 and the cutter reception cylinder 5 and in the vicinity of downstream ends of the guide bars 1, the paired rollers 60 and 60' facing each other with an appropriate gap present therebetween and rotating in mutually opposite directions; a single roller 61 provided downstream of the rollers 60 and 60' in a rotatable condition; and unillustrated two pairs of follower rollers and drive rollers provided downstream of the roller 61 in such a condition as to be rotatable in mutually opposite directions.

The endless belt 62' is looped around and mounted on the roller 60', the roller 61, and one pair of the follower and drive rollers (not shown) such that the inside surface thereof is in contact with these rollers. The other endless belt 62 is looped around and mounted on the roller 60 such that the inside surface thereof is in contact with the roller 60; looped around and mounted on the roller 61 such that the outside surface thereof is superposed on the endless belt 62'; and looped around and mounted on the other pair of the follower and drive rollers (not shown) while being superposed on the endless belt 62'.

In the conveyor 6, while being guided by the guide bars 1, a leading end portion of the paper web W is inserted into a gap between the endless belts 62 and 62' at the position of the rollers 60 and 60'; after the paper web W is cut to yield the sheet S, the sheet S is held between the endless belts 62 and 62' at the position of the roller 61, which is the starting position of transfer of the sheet S; and the sheet S is transported while being held between the endless belts 62 and 62'.

Next, the action of the above-described sheet delivery apparatus SD will be described with reference to FIGS. 1 to 4.

When the sheet delivery apparatus SD is activated, in FIG. 1, the cutter cylinder 4 and the cutter reception cylinder 5 rotate counterclockwise and clockwise, respectively, in a synchronous condition.

Also, the paired rollers 30 and 30'; the paired nipping rollers 2 and 2'; and the paired rollers 60 and 60' and the paired drive rollers (not shown) of the conveyor 6 rotate in mutually opposite directions as do the cutter cylinder 4 and the cutter reception cylinder 5.

A plurality of paper webs W' are introduced into the sheet delivery apparatus SD from an unillustrated upstream paper-feeding apparatus via an unillustrated printing apparatus. Each of the paper webs W' introduced into the sheet delivery apparatus SD travels while opposite surfaces thereof are in contact with the corresponding rollers 30' and 30 of the dampening units 3, which are provided in the vicinity of the path of the paper web W' in such a manner as to face the corresponding surfaces of the paper web W'. The roller 30 rotates at a speed higher than that of the roller 30', whereby the paper web W' is dampened such that the liquid 32 is supplied to a greater extent to the surface of the paper web W' which will face the cutter cylinder 4 than is supplied to the other surface which will face the cutter reception cylinder 5.

Next, as shown in FIG. 1, the paper webs W' are superposed on one another to thereby become the paper web W. The paper web W is nipped between the nipping rollers 2 and 2' and is fed into a region between the cutter cylinder 4 and the cutter reception cylinder 5 by means of the rotating nipping rollers 2 and 2'.

When a single paper web W' is introduced into the sheet delivery apparatus SD, the paper web W is also of a single layer.

Figure 3:
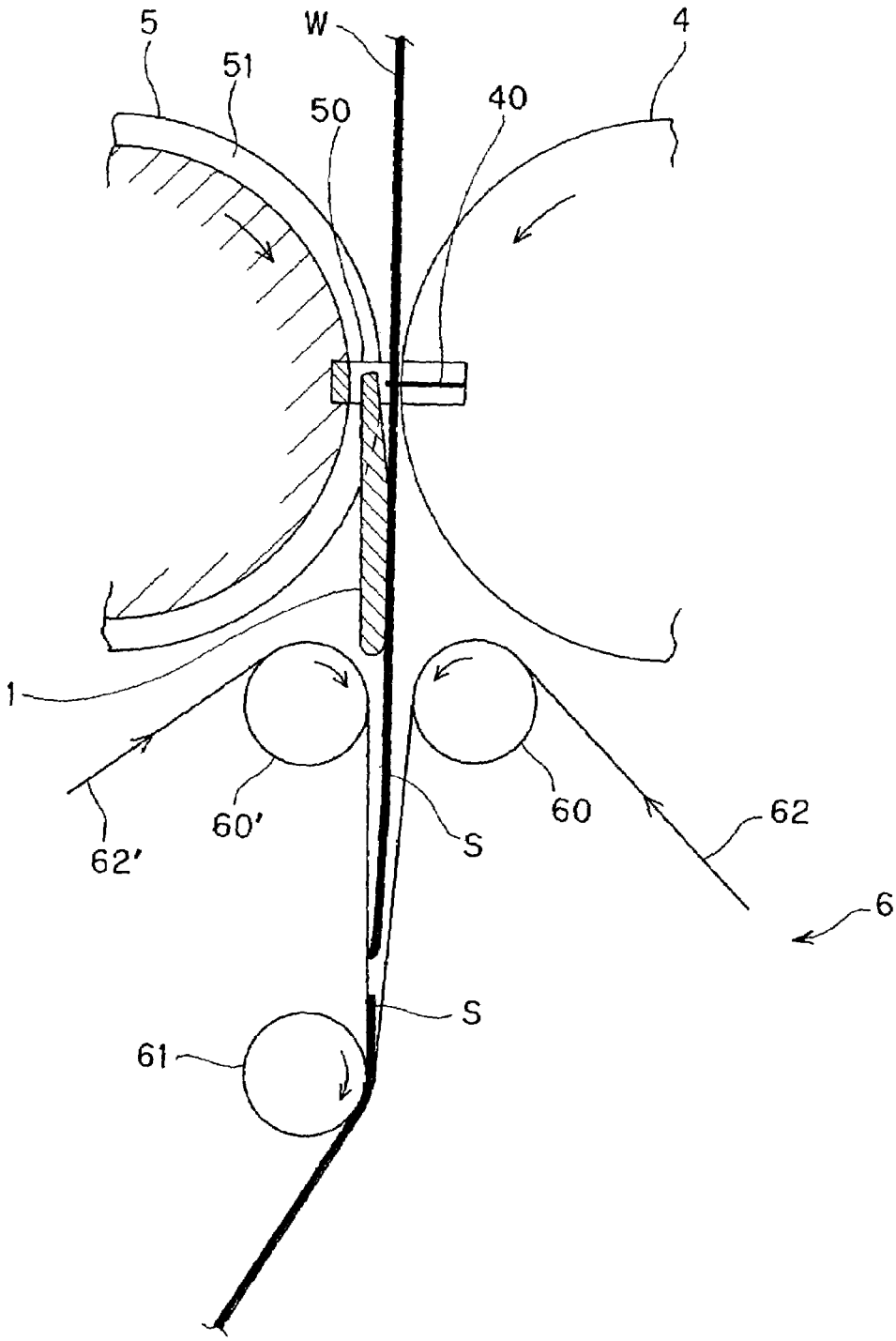
FIG. 3 is an enlarged partial view of FIG. 1 showing a condition at the time of cutting a paper web.

The multilayered paper web W is fed from the nipping rollers 2 and 2' to a closely facing region of the cutter cylinder 4 and the cutter reception cylinder 5, which rotate in the directions of the respective arrows shown in FIG. 3. The thus-fed paper web W undergoes cutting at the cutting position where the cutter blade 40 of the cutter cylinder 4 and the corresponding cutter receiver 50 of the cutter reception cylinder 5 mesh with each other, whereby a downstream leading end portion is cut and removed from the paper web W. Subsequently, sheets each having a length equal to the circumferential interval between the adjacent cutter blades 40 arranged on the cutter cylinder 4 are cut one after another from the paper web W.

Details about cutting of the paper web W will next be described. As shown in FIG. 3, while being held between the cutter receiver 50 and an outer surface portion of the cutter cylinder 4 where the cutter blade 40 is fixedly attached, a portion of the paper web W corresponding to the cutter receiver 50 is cut by the cutter blade 40 and the cutter receiver 50 meshing with each other.

Furthermore, as shown in FIGS. 2 and 3, since a portion of the paper web W corresponding to the cutter receiver 50—which portion excludes portions of the paper web W corresponding to the grooves 51 along the width direction of the paper web W—is held, as mentioned above, between the cutter receiver 50 and the outer surface portion of the cutter cylinder 4 where the cutter blade 40 is fixedly attached, when the cutter blade 40 cuts the portion of the paper web W corresponding to the cutter receiver 50, the portions of the paper web W corresponding to the grooves 51 are also cut without retreat into the grooves 51.

The dampening units 3 dampen the corresponding paper webs W' such that the surface of the paper web W' which will face the cutter cylinder 4 is dampened to a greater extent than is the other surface. Thus, a difference in degree of dampness arises between opposite surfaces of each of the paper webs W', whereby a difference in swelling of fiber arises between opposite surfaces of each of the paper webs W'.

Figure 4:
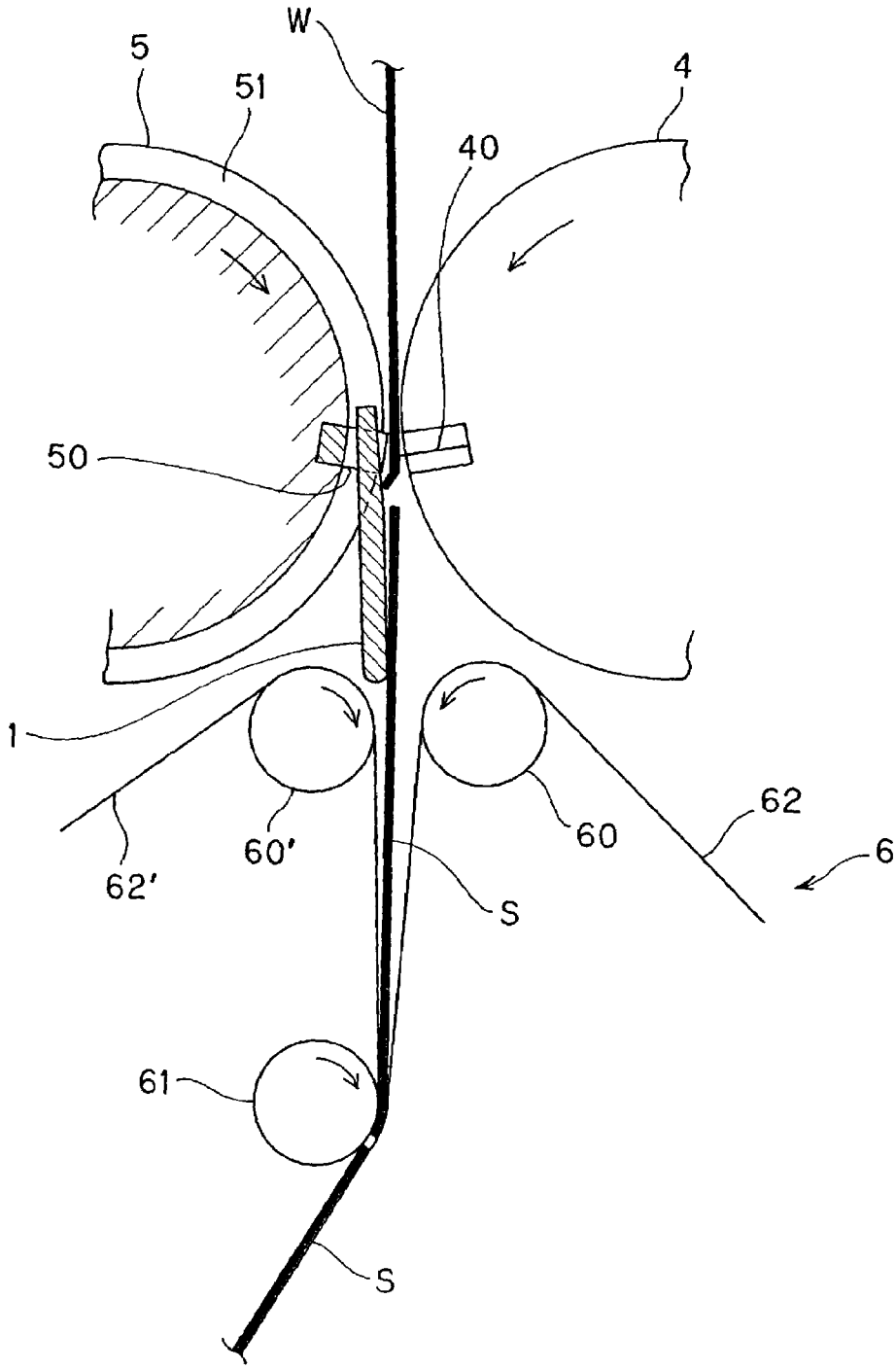
FIG. 4 is an enlarged partial view of FIG. 1 showing a cut end portion of a paper web.

Thus, as shown in FIG. 4, when the paper web W consisting of the paper webs W' arranged in layers undergoes cutting in the region between the cutter cylinder 4 and the cutter reception cylinder 5, a cut end portion of the paper web W is curved toward the cutter reception cylinder 5 and the guide bars 1.

Since the upstream ends the guide bars 1 are located upstream of the position at which the cutter blade 40 of the cutter cylinder 4 meshes with the corresponding cutter receiver 50 of the cutter reception cylinder 5, the paper web W is led into a region between the guide bars 1 and the outer circumferential surface of the cutter cylinder 4, and, at the time of cutting, a cut end portion of the paper web W which faces toward the cutter reception cylinder 5 is received by the guide bars 1. Thus, a cut end portion of the paper web W does not wind around the outer circumferential surface of either the cutter cylinder 4 or the cutter reception cylinder 5, and is guided along the guide bars 1 toward the downstream conveyor 6.

Next, as shown in FIG. 3, a cut end portion of the paper web W is inserted into a region between the endless belts 62 and 62' looped around and mounted on the respective rollers 60 and 60', which are disposed with an appropriate gap present therebetween and serve as an entrance to the conveyor 6. When the cut end portion of the paper web W reaches an upstream position located in the vicinity of the roller 61 where the endless belts 62 and 62' are superposed on each other, a portion of the paper web W which is passing through a region between the cutter cylinder 4 and the cutter reception cylinder 5 is cut through cooperation between the cutter and the corresponding cutter receiver, thereby yielding the sheet S of predetermined length.

The sheet S which has passed by the roller 61 is transported downstream while being held between the endless belts 62 and 62' of the conveyor 6 and is then delivered from the sheet delivery apparatus SD.

The above-described operation of cutting the paper web W is repeated so as to form the sheets S one after another. The thus-formed sheets S are sequentially delivered from the sheet delivery apparatus SD.

Obviously, numerous modifications and variations of the present invention are possible in light of the above teachings. It is therefore to be understood that within the scope of the appended claims, the present invention may be practiced otherwise than as specifically described herein.

What is claimed is:

1. A sheet delivery apparatus comprising:

a cutter cylinder having cutter blades provided on an outer circumferential surface of the cutter cylinder at equal circumferential intervals;

a cutter reception cylinder disposed in parallel with and in the vicinity of the cutter cylinder and having cutter receivers provided on an outer circumferential surface of the cutter reception cylinder at equal circumferential intervals, the cutter cylinder and the cutter reception cylinder being rotated synchronously in such a manner that the cutter blades and the corresponding cutter receivers meet and cut the paper web to obtain sheets of a predetermined length;

a conveyor provided downstream of a closely-facing region where the cutter cylinder and the cutter reception cylinder closely face each other and adapted to convey the sheets;

at least one dampening unit provided upstream of the closely-facing region and in the vicinity of a paper web path, the dampening unit being adapted to dampen a surface of the paper web so as to raise a difference in degree of dampness between opposite surfaces of the paper web in such a manner that a cut end portion of the paper web is curved toward the cutter reception cylinder; and at least one guide bar disposed in a groove formed circumferentially on an outer circumferential surface of the cutter reception cylinder, the guide bar extending substantially in parallel with the traveling direction of the paper web and, in the groove, passing through an imaginary plane including an axis of the cutter cylinder and an axis of the cutter reception cylinder.

2. A sheet delivery apparatus according to claim 1, wherein the guide bar is inserted in the groove of the cutter reception cylinder in such a manner as not to come into contact with the cutter reception cylinder; an upstream end of the guide bar is located upstream of a position where the cutter blade of the cutter cylinder meshes with the corresponding cutter receiver of the cutter reception cylinder; and a downstream end of the guide bar is located in the vicinity of an entrance to the conveyor.

3. A sheet delivery apparatus according to claim 1 or 2, wherein the dampening unit is provided for each of opposite surfaces of the paper web.

4. A sheet delivery apparatus according to claim 1 or 2, wherein the dampening unit is provided for a surface of the paper web which surface faces the cutter cylinder.

* * * * *